US008136630B2

(12) United States Patent
Schnitta

(10) Patent No.: US 8,136,630 B2
(45) Date of Patent: Mar. 20, 2012

(54) ARCHITECTURAL ACOUSTIC DEVICE

(76) Inventor: Bonnie Schnitta, East Hampton, NY (US)

( * ) Notice: Subject to any disclaimer, the term of this patent is extended or adjusted under 35 U.S.C. 154(b) by 82 days.

(21) Appl. No.: 12/132,090

(22) Filed: Jun. 3, 2008

(65) Prior Publication Data

US 2009/0000864 A1 Jan. 1, 2009

Related U.S. Application Data

(60) Provisional application No. 60/943,141, filed on Jun. 11, 2007.

(51) Int. Cl.
*E04B 1/82* (2006.01)
*E04B 1/84* (2006.01)
*E04B 1/74* (2006.01)

(52) U.S. Cl. ..... 181/286; 181/295

(58) Field of Classification Search ..... 181/286, 181/295, 284, 293, 250
See application file for complete search history.

(56) References Cited

U.S. PATENT DOCUMENTS 1,662,742 A * 3/1928 Glassman ..... 181/141
1,816,618 A * 7/1931 Sklar ..... 181/158
2,068,590 A * 1/1937 Applestam ..... 181/141
D138,386 S * 7/1944 Volf ..... D14/207
2,390,262 A * 12/1945 Mazer ..... 52/506.01
2,488,555 A * 11/1949 Pare ..... 181/295
2,502,016 A * 3/1950 Olson ..... 181/295
2,502,020 A * 3/1950 Olson ..... 181/295
2,528,049 A 10/1950 Gonda
2,715,449 A * 8/1955 Smith et al. ..... 181/30
3,275,101 A * 9/1966 Davis, Jr. et al. ..... 181/285
3,411,605 A * 11/1968 Coffman et al. ..... 181/30
3,866,001 A * 2/1975 Kleinschmidt et al. ..... 181/285
4,071,989 A * 2/1978 Warren ..... 52/145
4,094,379 A * 6/1978 Steinberger ..... 181/284
4,226,299 A * 10/1980 Hansen ..... 181/284
4,319,661 A * 3/1982 Proudfoot ..... 181/295
4,548,292 A * 10/1985 Noxon ..... 181/295
4,605,088 A * 8/1986 Sickels ..... 181/30
4,821,841 A * 4/1989 Woodward et al. ..... 181/286
5,035,298 A * 7/1991 Noxon ..... 181/295
5,137,111 A * 8/1992 Diduck et al. ..... 181/295
5,141,073 A * 8/1992 Pelonis ..... 181/30
5,210,383 A * 5/1993 Noxon ..... 181/290
5,317,113 A * 5/1994 Duda ..... 181/285
5,403,080 A * 4/1995 Thee ..... 312/204
5,444,194 A * 8/1995 Reinke ..... 181/150

(Continued)

FOREIGN PATENT DOCUMENTS

JP 05232967 A * 9/1993

OTHER PUBLICATIONS

International Search Report issued in Application No. PCT/US08/065620 mailed Aug. 11, 2008.

(Continued)

*Primary Examiner* — Edgardo San Martin
(74) *Attorney, Agent, or Firm* — John F. Vodopia

(57) ABSTRACT

An acoustic device and a method for altering sound. The acoustic device includes an architectural structure having a solid body. The architectural structure is adapted to be mounted on a wall of a room. The solid body has a channel therethrough to define a cavity therein. The channel is configured to alter sound waves incident on the acoustic device.

42 Claims, 7 Drawing Sheets

U.S. PATENT DOCUMENTS

| | | | | |
|---|---|---|---|---|
| 5,444,198 | A * | 8/1995 | Gallas | 181/295 |
| 5,512,715 | A * | 4/1996 | Takewa et al. | 181/295 |
| 5,598,669 | A * | 2/1997 | Hamdi et al. | 52/144 |
| 5,700,983 | A * | 12/1997 | VonDross | 181/285 |
| 5,959,265 | A * | 9/1999 | Van Ligten | 181/286 |
| 6,015,026 | A * | 1/2000 | McGrath | 181/295 |
| 6,021,612 | A * | 2/2000 | Dunn et al. | 52/144 |
| 6,056,083 | A * | 5/2000 | Daniell | 181/199 |
| 6,167,985 | B1 * | 1/2001 | Van Ligten | 181/286 |
| 6,244,378 | B1 | 6/2001 | McGrath | |
| 6,321,871 | B1 * | 11/2001 | Russell | 181/295 |
| 6,435,303 | B1 * | 8/2002 | Warnaka | 181/286 |
| 6,457,554 | B1 | 10/2002 | Wang | |
| 6,568,135 | B1 * | 5/2003 | Yokoyama et al. | 52/145 |
| 6,769,509 | B2 * | 8/2004 | Harwood | 181/199 |
| 6,892,856 | B2 * | 5/2005 | Takahashi et al. | 181/293 |
| 7,178,630 | B1 * | 2/2007 | Perdue | 181/290 |
| 2005/0258000 | A1 * | 11/2005 | Yano et al. | 181/210 |
| 2006/0260870 | A1 * | 11/2006 | Nakagawa et al. | 181/295 |
| 2009/0255753 | A1 * | 10/2009 | Schnitta | 181/205 |
| 2009/0285432 | A1 * | 11/2009 | Schnitta et al. | 381/353 |

OTHER PUBLICATIONS

Written Opinion issued in Application No. PCT/US08/065620 mailed Aug. 11, 2008.

* cited by examiner

FILLET

FASCIA

CONGÉ

CAVETTO

SCOTIA

OVOLO

ECHINUS

TORUS

ASTRAGAL HEAD

THUMB

3/4 HEAD

CYMA RECTA

CYMA REVERSA

BEAK

ARCHITECTURAL ACOUSTIC DEVICE

CROSS-REFERENCE TO RELATED APPLICATION

This application is based on and derives the benefit of the filing date of U.S. Patent Application Ser. No. 60/943,141, filed Jun. 11, 2007. The entire contents of this application is herein incorporated by reference in its entirety.

FIELD OF THE INVENTION

The present invention relates generally to sound modifying structures and more particularly to sound modifying architectural structures.

DESCRIPTION OF EMBODIMENTS OF THE INVENTION

Figure 1A:
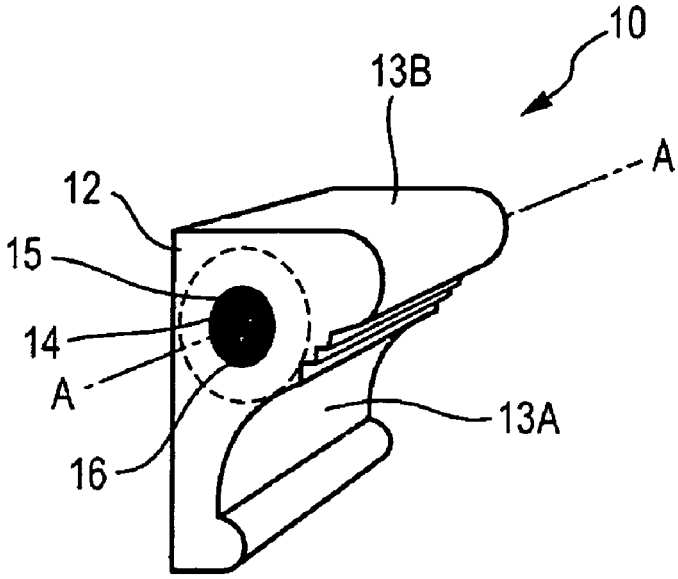
FIGS. 1A and 1B are three-dimensional views of an acoustic architectural device for altering sound energy, according to various embodiments of the present invention.
Figure 1B:
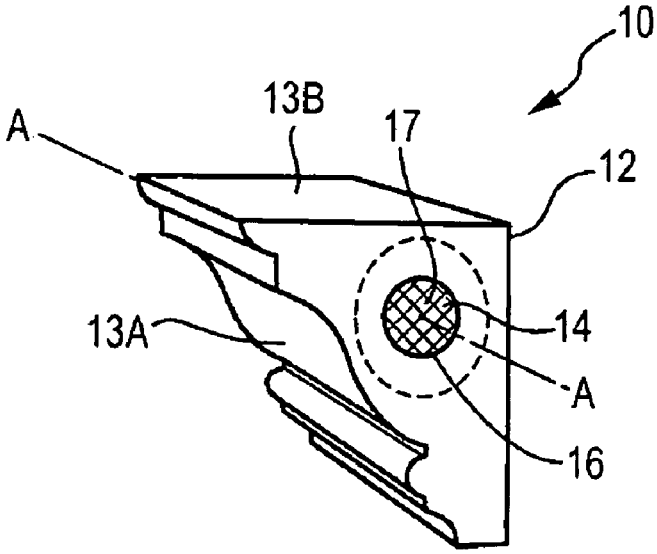
Figure 2:
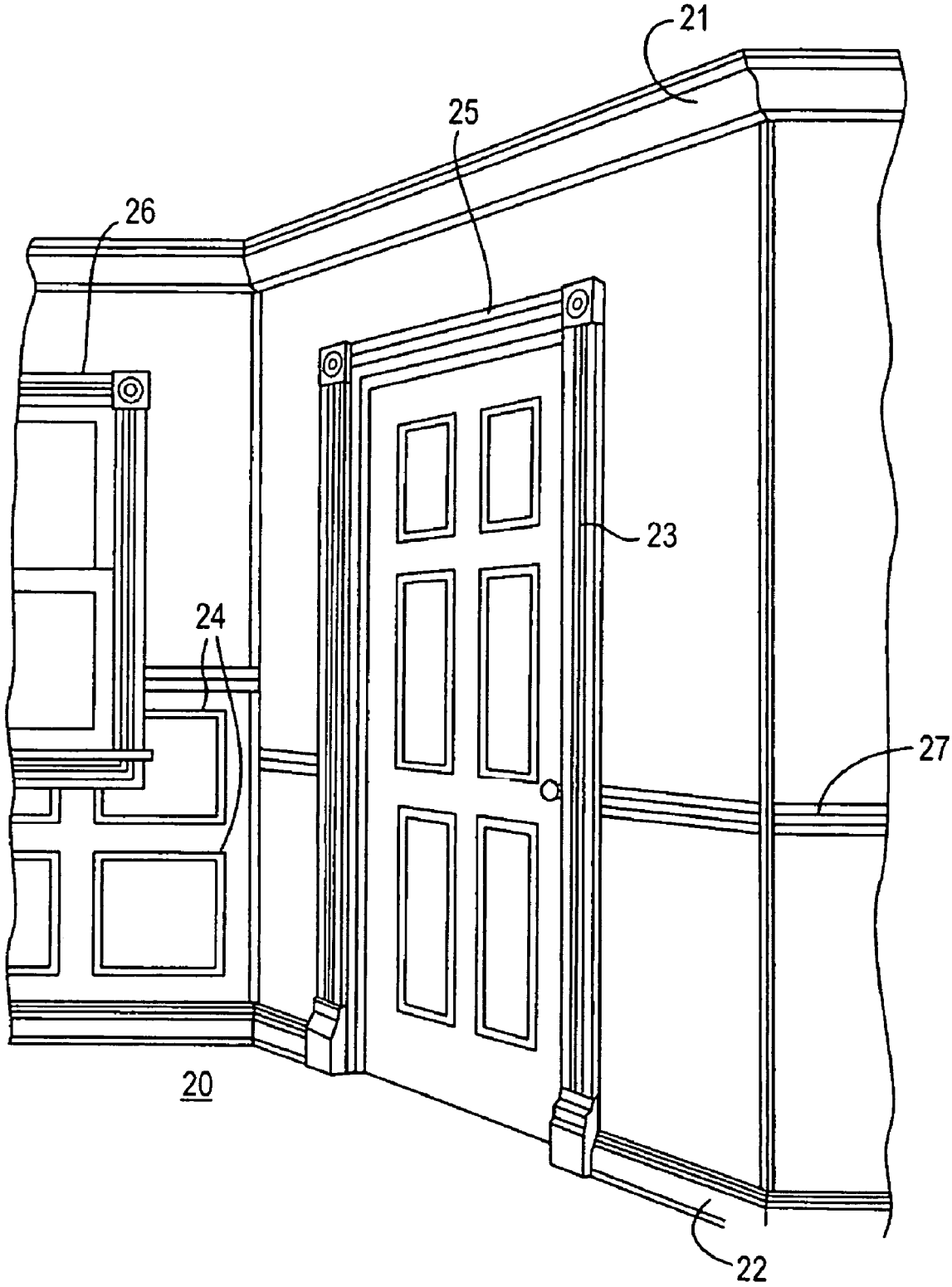
FIG. 2 shows some examples of architectural structures that can be used for the acoustic architectural device depicted in FIGS. 1A and 1B.

FIGS. 1A and 1B are three-dimensional views of an acoustic architectural device for altering sound energy level in a room, according to various embodiments of the present invention. The device 10 for altering sound energy level comprises a solid body 12. The solid body 12 can be an architectural structure or any other room structure. FIG. 2 shows some examples of architectural structures that can be used in the device for altering sound energy level 10. The architectural structure can be any one of standard architectural structures that can be used in a room 20, such as ceiling moldings or crown moldings 21, floor moldings 29, frames such as door frame 23, wall frames 24, door trim 25, window trim 26, chair rails 27, banisters and balustrades, baseboards, beams such as ceiling beams, fireplace mantels, picture frames, and other architectural structures (not specifically depicted in FIG. 2).

The solid body 12 can be made from any solid material including, but not limited to, wood, plastic, fibrous material such as paper or fiber board, or metal, or a combination of one or more of these materials. The solid body 12 can be made from a material that is acoustically absorptive, such as foam, or it can be made from a material having tabulated absorption coefficients such as wood, fiber board, plastic and the like, or it can also be made from acoustically reflective materials, such as synthetic plastic compounds, metal (e.g., aluminum), or a combination of these materials. For example, the solid body 12 can be made from a laminated material including layers of various materials or from a composite material. The solid body 12 can be provided with a certain surface texture to increase or decrease sound reflection, sound diffraction or sound diffusion. The external surface of the solid body 12 can also be finished with a paint layer. The paint layer can be acoustically transparent. The solid body 12 can also be covered with an acoustic material, for example, a sound absorbing material, etc.

Figure 3A:
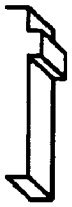
FIG. 3A-3N shows various cross-sectional shapes of the architectural structures depicted FIG. 2.
Figure 3B:
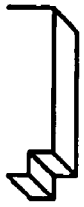
Figure 3C:
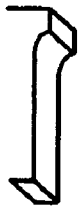
Figure 3D:
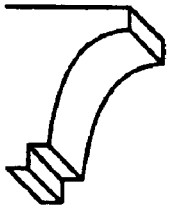
Figure 3E:
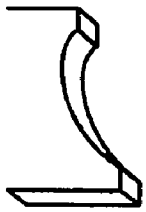
Figure 3F:
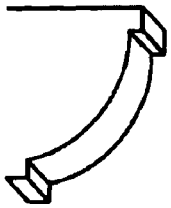
Figure 3G:
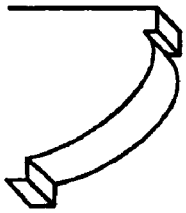
Figure 3H:
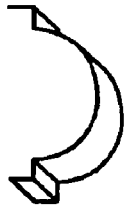
Figure 3I:
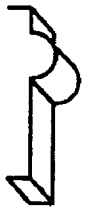
Figure 3J:
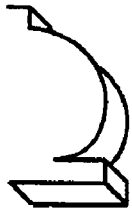
Figure 3K:
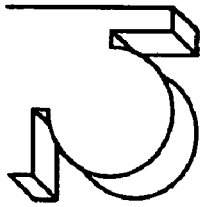
Figure 3L:
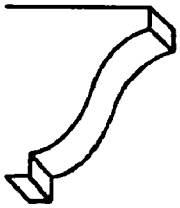
Figure 3M:
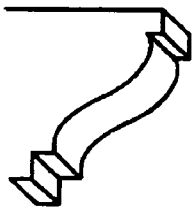
Figure 3N:
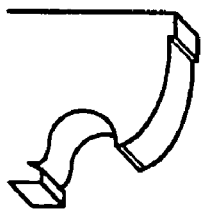

As shown in FIGS. 3A-3N, the solid body 12 can be produced in any desired shape, style, or size to fit any application such as applied as a trim around a window, applied as a trim around a door, applied as a ceiling molding, and the like. The solid body 12 can have a straight cross-sectional shape, curved cross-sectional shape including concave and convex shapes, or other shapes which include a combination of the straight, concave and/or convex shapes.

Straight cross-sectional shapes can have sharp angular corners and can create highly diffractive surfaces for high frequency sounds. Straight shapes include, for example, "the fillet" (small straight shape) shown in FIG. 3A and "the fascia" (large flat shape) shown in FIG. 3B.

Curved cross-sectional shapes include concave shapes and convex shapes (relative to a position in the room). Convex cross-sectional shapes scatter high frequency sound and concave cross-sectional shapes focus sound. A concave shape has at least one center of curvature located inside a volume of the room towards an occupant of the room (e.g., a listener) and a convex shape has at least one center of curvature outside the volume of the room, away from the listener. Concave shapes include "the cavetto" shown in FIG. 3D, "the scotia" shown in FIG. 3E, and "the conge" shown in FIG. 3C (which combines straight and curved structures in one profile). Convex shapes include "the ovulo" shown in FIG. 3F, "the echinus" shown in FIG. 3G, "the torus" shown in FIG. 3H (a relatively large protruding semi-cylinder), "the astragal" or head shown in FIG. 3I (a small protruding semi-cylinder), "the thumb" shown in FIG. 3J; "the three-quarter head" shown in FIG. 3K (exposing about three quarters of a cylinder). Compound profiles include "the cyma recta" shown in FIG. 3L (resembling a cresting wave), "the cyma reversa" shown in FIG. 3M (the opposite of a cresting wave), and "the beak" shown in FIG. 3N (incorporating curves and straight edges).

The architectural shapes and structures depicted in FIGS. 2 and 3A-3N can be used for decorative purposes. Sound waves having a wavelength smaller than a width of the architectural structure are reflected in different ways. Flat shapes can cause direct reflections and echoes. The reflections can be intensified or focused with concave shapes. On the other hand, convex shapes scatter or diffuse sound waves and minimize echoes.

Generally, when sound energy encounters a physical structure, such as any architectural structure in a room, it is partially reflected, partially transmitted through the structure, and partially absorbed and converted into heat. The architectural structures in a room can sometimes produce undesirable sound effects. For example, flutter echo results when high frequency sound bounces back and forth between two parallel walls (within the same room or within adjoining rooms) without being absorbed or diffused. At lower sound frequencies, there may be areas characterized by higher and lower sound intensity. These effects are caused by standing waves that depend on the physical dimensions of the reverberant space, i.e., the room modes. The change in density between physical structures, for example, between different materials and a solid wall, may also cause undesirable diffraction and dispersion of sound as well.

Returning to FIGS. 1A and 1B, the sound altering device 10 also comprises one or more channels 14 provided in the solid body 12. Although one channel is depicted in FIGS. 1A and 1B, two or more channels can also be provided. The channel 14 can be made by mechanically drilling through the solid body 12. The channel 14 can also be made by carving material from two or more portions of the solid body 12 and then assembling the two or more portions of solid body 12 to form the channel 14 inside the solid body 12. Alternatively, the channel 14 can be made during the fabrication of the solid body 12. For example, the solid body 12 can be provided with the channel 14 during an extrusion process (e.g., during the extrusion of plastic).

Although the channel 14 is shown in FIGS. 1A and 1B having a circular cross-section, the channel 14 can have any cross-section including a polygonal (e.g., triangular, square, rectangular, hexagonal, etc.) cross-section, a semi-circular cross-section, an oval cross-section, a semi-oval cross-section or a more complex cross-section such as a star-shape cross-section or the like. The channel 14 can be open on both ends, can be closed on one of its ends or closed on both of its ends. FIG. 1A shows a channel 14 having its extremity 15 closed (illustrated in FIG. 1A by a black disk). FIG. 1B shows a channel 14 having its extremity 17 open to the air (illustrate in FIG. 1B by a thatched disk).

In one embodiment, the channel 14 can be configured to run parallel to a lateral surface 13A of solid body 12 which faces the room. In other words, the channel 14 can be configured such that a director axis AA of the channel 14 runs parallel to an imaginary line in the lateral surface 13A of the solid body 12. Alternatively, the channel 14 can be configured to run not parallel relative to lateral surface 13A of the solid body 12, i.e., the director axis AA does not run parallel to the lateral surface 13A, in which case the channel 14 would have an end at the lateral surface 13A. As a result, the channel 14 can be made of series of zigzagging portions of channels that have one or more ends, i.e. which begin or end, on the lateral surface 13A of solid body 12. The one or more ends of the channel 14 on the lateral surface 13A of the solid body 12 can be open to air or closed. Furthermore, the channel 14 can also be configured to run not parallel to any surface of the solid body 12. For example the channel 14 can be configured to run not parallel to a surface 13B which can be, for example, a surface that comes in contact with a wall of the room. In addition, the channel 14 can be made the run in a curved conformation, such as serpentine conformation, instead of a straight conformation.

In one embodiment, at least a portion of the surface of the channel 14 is lined with an acoustic material 16. Depending on the acoustical requirements, the entire surface of the channel can be lined with the acoustic material (acoustic liner) 16, or a portion of the surface can be lined with the acoustic material 16. A thickness of the acoustic material can also be selected according to desired acoustic effects. In FIGS. 1A and 1B, the thickness of the acoustic liner 16 can be seen as the space between the solid line defining the channel 14 and the dotted line representing the interface between the acoustic material liner 16 and the material of the solid body 12.

Figure 4A:
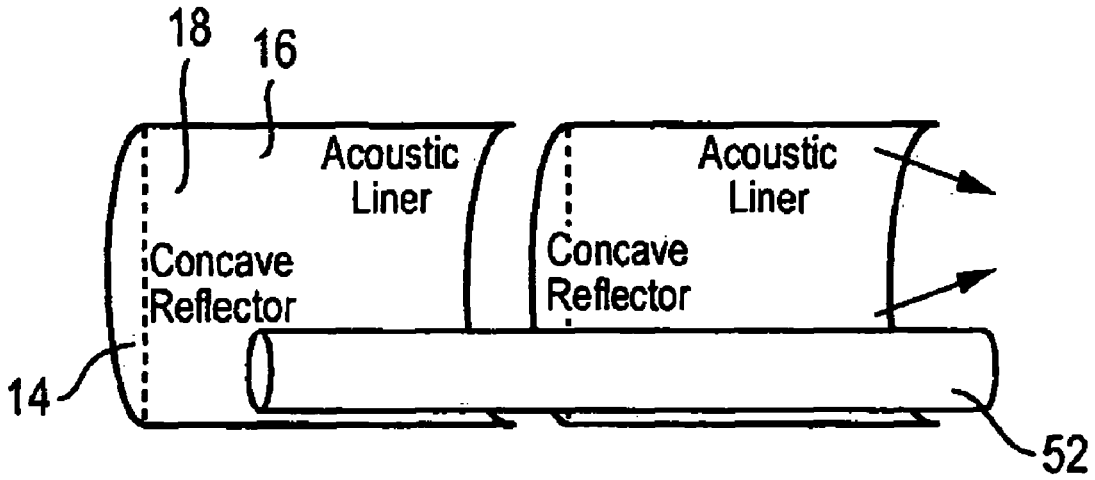
FIG. 4A shows an acoustic liner disposed on a concave half-surface of a channel in an acoustic architectural device, according to an embodiment of the present invention.

For example, as depicted in FIG. 4A a concave half-surface 18 of the channel 14, i.e., the surface 18 that is closest to a wall in a room and farthest from an occupant of the room, can be lined with the acoustic material 16 to absorb, reflect and/or scatter sound waves. When the acoustic architectural device 10 is to be used to absorb and/or reflect and focus the sound towards the center of the cavity of the channel 14 (as shown by the arrows in FIG. 4A), the acoustic liner is placed in a concave semi-cylindrical orientation, as shown in FIG. 4A. Even though the external surface of the solid body 12 may have a flat or convex or a more complex shape, the resultant acoustic architectural device 10 functions as an absorber and/or as a concentrator of sound waves. The proportion of sound energy that is reflected and focused towards the cavity of the channel, and sound energy that is absorbed by the acoustic architectural device 10 depends on the material used in the liner 16 disposed on surface 18 of the channel 14 and the material of the solid body 12.

Figure 4B:
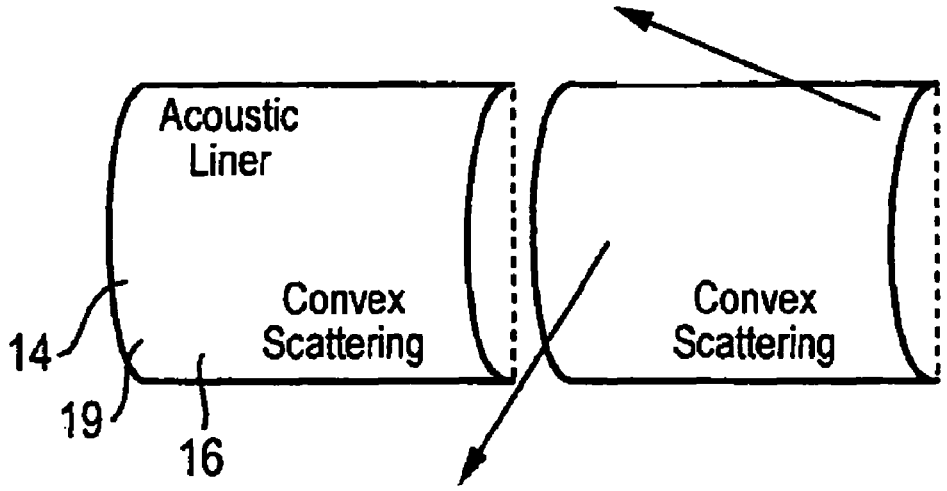
FIG. 4B shows an acoustic liner disposed on a convex half-surface of a channel in an acoustic architectural device, according to an embodiment of the present invention.

Alternatively or in addition, as shown in FIG. 4B, the convex half surface 19 of the channel 14, i.e., the surface 19 that is farthest from a wall of a room and closest to an occupant of the room, can be lined with the acoustic material 16. When the acoustic architectural structure 10 is to be used to diffuse or scatter sound (as illustrated by the arrows in FIG. 4B), the acoustic liner 16 is placed in a convex semi-cylindrical orientation, as shown in FIG. 4B to maximize scattering. Even though portions of the external surface of the solid body 12 of the acoustic architectural device 10 may be flat or concave, the acoustic architectural device 10 can function as an absorber and diffuser. The proportion of the sound energy that is reflected and/or absorbed by the acoustic architectural device 10 depends on the material used in the liner 16 and the material of the solid body 12 of acoustic architectural device 10. For applications requiring scattering and less absorption, the acoustic liner 16 can be manufactured from a material having a low absorption coefficient. For applications requiring scattering and more absorption, the acoustic liner 16 can be manufactured from a material having a high absorption coefficient.

Figure 4C:
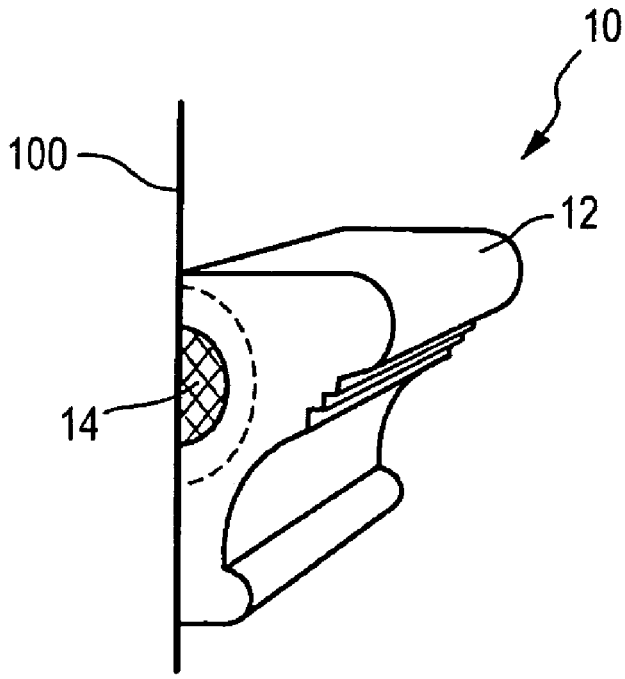
FIG. 4C shows a channel in an acoustic architectural device having a semi-cylindrical configuration, according to an embodiment of the present invention.

Furthermore, as shown in FIG. 4C, the solid body 12 of architectural structure 10 can also be provided with a channel 14 having a semi-cylindrical configuration with a semi-circular cross-section, according to an embodiment of the present invention. In this case, the concave surface, i.e., the semi-cylindrical surface, of the channel 14 can be lined with an acoustic liner 16, or the flat surface of the channel 14, i.e., the surface open to air or delimited by a wall 100 in a room can be lined with an acoustic liner 16, or both the concave surface and the flat surface of the channel 14 lined with the acoustic liner 16. In one embodiment, the architectural structure 10 can be acoustically sealed to wall 100. In another embodiment, the architectural structure 10 can be acoustically sealed on the open flat side of the semi-cylindrical channel 14 by an acoustic lining and then fixed to wall 100.

Concave or convex absorbers absorb mid-frequency to high-frequency sound. Convex acoustic liners scatter or diffuse mid-frequency to high-frequency sound. Absorbing and scattering frequencies are tuned by adjusting the volume, shape, and/or depth of the acoustic channel.

Many of the examples of moldings illustrated in FIGS. 3A through 3N, either as illustrated or with minor changes, can additionally act as bass traps if made of the correct materials. For example, the molding of FIG. 3K can be used as is as a bass trap if it is positioned on a vertical wall spaced from a ceiling by a distance similar to the gap between the circular portion and the upper rectangular portion of the molding in a vertical direction. The molding of FIG. 3G can act as a bass trap if the molding is modified so that the lower end of the curved section is modified to have a recessed area similar to the upper end of the curved portion. In each case, the molding can be made of compressed fiberglass or wood. The dimensions of the recessed portions, the air space behind the molding, if any, the distance of the molding from the ceiling, and/or the material of the molding may be adjusted to match the desired low frequency response.

The acoustic liner 16 on concave surface 18 and on convex surface 19 can be selected from a variety of materials having known acoustic properties. The liner 16 can be, for example, a tube or a portion of a tube of sound absorbing vinyl. The tube, i.e., the cavity of the channel 14, can also be filled with a sound dampening or sound absorbing material such as cotton or Dacron®. A tube or a portion of a tube of metal such as aluminum can also be used to enhance reflection of sound waves in certain applications. The acoustic liner can be selected so that the acoustic architectural device absorbs and/or reflects a certain frequency or a range of frequencies of incident sound waves. In addition, the thickness of the acoustic liner 16 can also be tailored to absorb a certain amount, more or less, of the incident sound waves.

Figure 5:
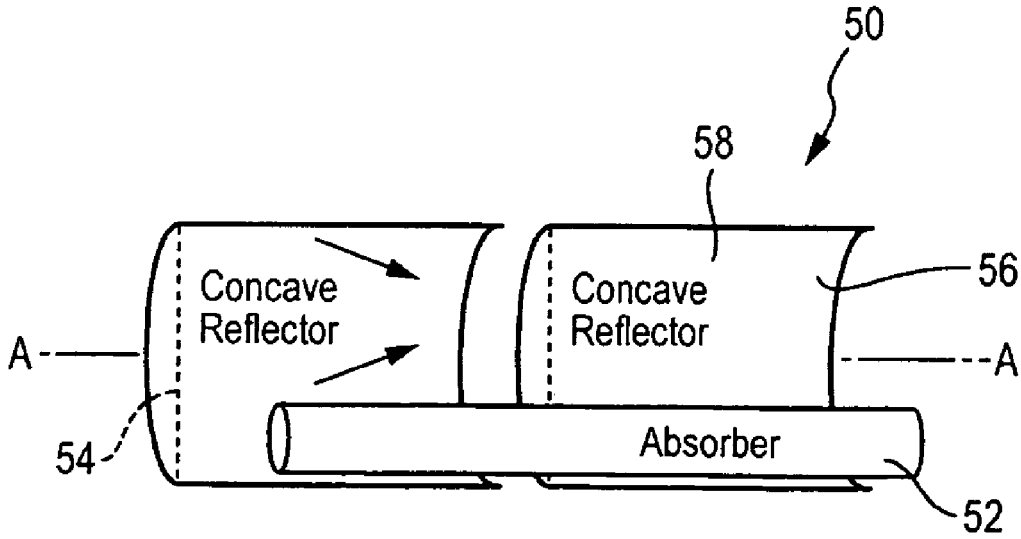
FIG. 5 depicts an acoustic architectural device having a secondary absorber disposed inside a channel of the acoustic architectural device, according to an embodiment of the present invention.

In yet another embodiment, the acoustic liner is arranged in a concave configuration inside the channel and a secondary absorber is provided inside the channel. FIG. 5 depicts an acoustic architectural device 50 having a secondary absorber 52 disposed inside a channel 54. In the acoustic architectural device 50, the concave half surface 56 of the channel 54, is lined with the acoustic material 58 to absorb, reflect and/or scatter sound waves. High frequency sounds that are not absorbed by the liner 58 on concave surface 56 are directed or focused into the secondary absorber 52. The secondary absorber 52 absorbs the reflected, non-absorbed sound waves from the liner 58. The secondary absorber 52 extends along the axis AA of the acoustic channel 54. The secondary absorber 52 can be positioned inside the channel 54 in such away that sound waves reflected by the concave half surface 56 of the channel 54 and not absorbed by the acoustic liner 58 are absorbed by the secondary absorber 52. The secondary absorber 58 can be selected from any available sound absorbing materials.

One approximation of effects of absorption by an acoustic liner is the Sabine reverberation time. The reverberation time that measures the echo tendencies in a room having volume V and absorbing area A (in units of feet) at a frequency f is:

$$T_{60}(f) = \frac{0.49 \cdot V}{c \cdot A(f)}, \tag{1}$$

where (2)

$$A(f) = \sum_{n=1}^{N} \alpha_n(f) \cdot A_n$$

N being a number of surfaces in the room, c being the speed of sound, $A_n$ being the area of surface n and $\alpha_n(f)$ being the absorption coefficient of surface n at the frequency f.

The area of an acoustic liner placed in a convex or concave semi-cylindrical orientation having diameter d and length L is:

$$A=(\pi/2)\cdot d\cdot L \tag{3}$$

Therefore, the effective increase in room acoustic absorption due to the acoustic liner can be calculated as follows:

$$\alpha(\pi/2)\cdot d\cdot L, \tag{4}$$

where $\alpha$ is the absorption coefficient of the acoustic liner.

For example, for a single acoustic architectural structure having a length of approximately 40 feet provided with an acoustic liner disposed on a surface of a channel having a diameter of about 4 inches, the increase in absorption is about 21$\alpha$ Sabins. Since the reverberation time is inversely proportional to the absorption, as expressed in equation (1), an increase in absorption results in a decrease in reverberation time. Hence by measuring the reverberation time, the chance in sound absorption in a room can be quantified.

As stated above, the channel 14 can be open on both ends, or can have one or both of its ends closed. In the case where the channel 14 has only one opening, i.e., one end of the channel is closed while the other end is open to the air, this corresponds to a Helmholtz acoustic absorber whose tuning frequency depends on the volume of the acoustic channel.

Figure 6:
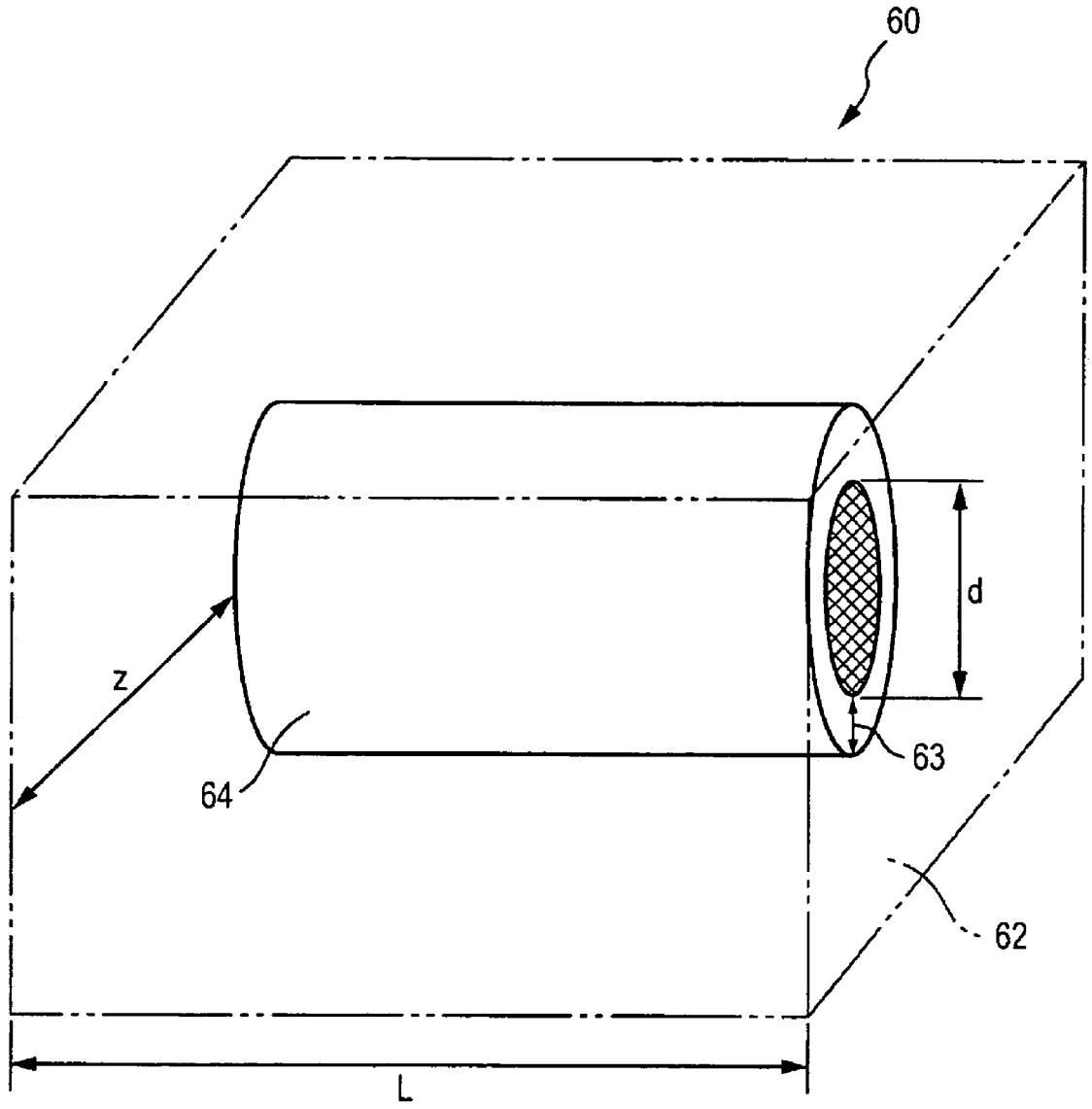
FIG. 6 depicts a schematic view of a Helmholtz acoustic absorber architectural device, according to an embodiment of the present invention.

FIG. 6 depicts a schematic view of a neckless Helmholtz acoustic absorber architectural device 60 having solid body 62 and a cylindrical acoustic channel 64. In this embodiment, the acoustic channel 64 is open on one end to the air. In this embodiment, the cylindrical acoustic channel 64 is shown lined with all acoustic liner 63 having a certain thickness indicated in FIG. 6 by a double-arrow. However, the cylindrical acoustic channel may or may not be lined with the acoustic liner 63. The cylindrical acoustic channel 64 has a diameter d and a length L. This allows to calculate the volume of the acoustic channel $\pi(d^2/4)$ L. The thickness z of the solid body 62 is defined as the maximum distance between the external surface of the solid body 62 of the architectural structure 60 to the interface between the solid body 62 and the channel 64. The absorbing frequency $f_H$ of the Helmholtz absorber is determined by the following equation:

$$f_H = \frac{1127 \cdot d}{4\sqrt{\pi \cdot V \cdot (z + 1.7 \cdot d/2)}} \tag{5}$$

By substituting the volume of the acoustic channel $\pi(d^2/4)$ L into equation (5), the absorbing frequency $f_H$ can be expressed as follows:

$$f_H = \frac{1127 \cdot d}{4\sqrt{\pi^2 \cdot (d^2/4) \cdot L \cdot (z + 1.7 \cdot d/2)}} \tag{6}$$

For example, in the case where the acoustic architectural device 60 has a maximum thickness of about 1 inch, i.e., z=1 inch, a length of about 40 feet, i.e., L=40 feet, and has an acoustic channel with a diameter of 4 inches, i.e., d=4 inches, the calculated frequency of absorption is about 47 Hertz. The frequency is inversely proportional to the length L and to the diameter d of the acoustic channel. Hence, by using architectural acoustic devices having an acoustic channel with greater lengths and/or greater channel diameters, the absorption frequency of the acoustic device can be tuned to lower frequencies. Alternatively, by using architectural devices having an acoustic channel with smaller lengths and/or smaller channel diameters, the absorption of the architectural acoustic device can be tuned to higher frequencies.

Figure 7:
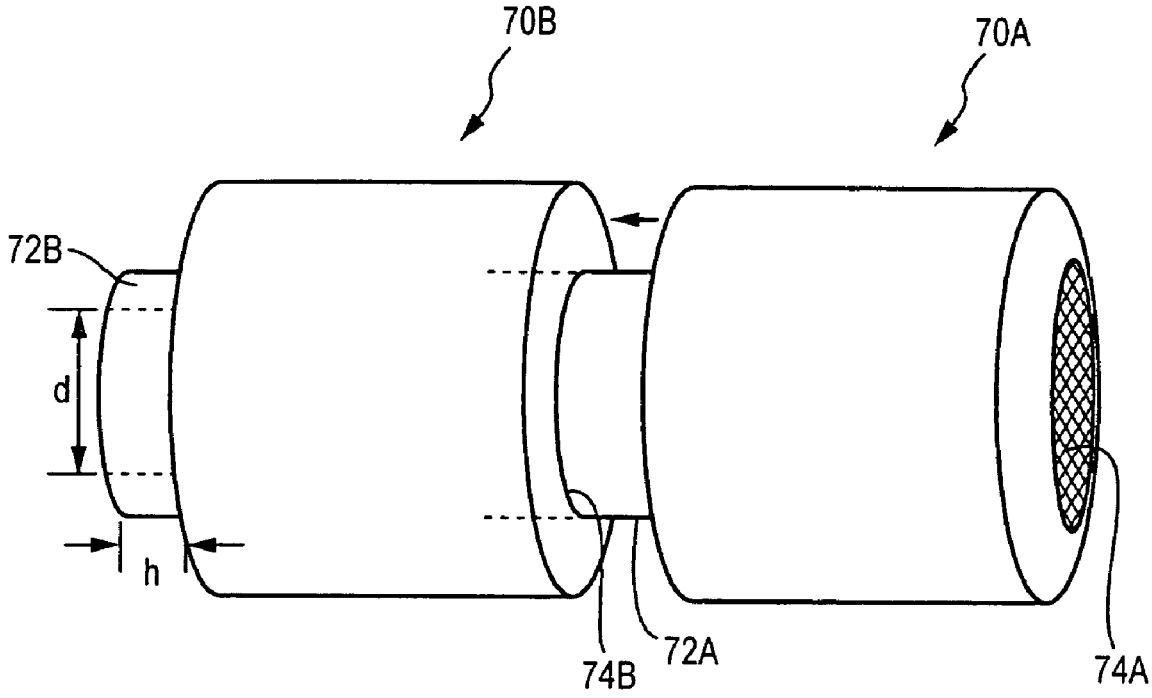
FIG. 7 shows a schematic view of two acoustic architectural devices adjoined together, according to an embodiment of the present invention.

FIG. 7 shows a schematic view of two acoustic architectural devices 70A and 70B provided with external connecting portions or necks 72A and 72B, respectively, for adjoining the two acoustic architectural devices 70A and 70B. For example, the connecting portion (neck) 72A can be used to connect two acoustic channels 74A and 74B provided in the two architectural structures 70A and 70B, as illustrated in FIG. 7. This can be accomplished by inserting the external connecting portion (neck) 72A into the channel 74B as illustrated by the arrow in FIG. 7 or, alternatively, inserting the external connecting portion (neck) 72B into the channel 74A.

If for example, the channel 74A of the acoustic architectural device 70A has only one end (end of the neck 72A) open to the air and the other end (end opposite to the neck 72A) is closed, the architectural structure 70A functions as a "traditional" Helmholtz absorber, i.e., a Helmholtz absorber with a neck. Similarly, if the channels 74A and 74B of the acoustic architectural devices 70A and 70B are adjoined to form a combined single acoustic architectural device (70A, 70B) in which one end of channel 74A (end opposite to the neck 72A) is closed to form an acoustic architectural device (70A, 70B) with a neck 72A or one end of channel 74B (end opposite to the neck 72B) is closed to form an acoustic architectural device (70A, 70B) with a neck 72B, the combined acoustic architectural device (70A, 70B) functions also as a "traditional" Helmholtz absorber. The absorbing frequency of a "traditional" Helmholtz absorber is calculated as follows:

$$f(\mathrm{Hz}) = \frac{c \cdot d}{4 \cdot \sqrt{\pi \cdot \mathrm{V} \cdot h}}, \tag{7}$$

where, h is the height of the protruding connecting portion or neck (e.g., portion 72A or portion 72B), d is the inside diameter of the connecting portion 74A, V is the volume of the cavity of the channel 74A or the combined channel 74A and 74B and c is the speed of sound. Hence, by changing the volume of the cavity of the channel, the height of the protruding connecting portion and/or the diameter of the connecting portion, the acoustic architectural device can be tuned to absorb specific frequency or frequencies.

Any acoustic architectural structure functioning as a Helmholtz absorber must have acoustically sealed channels with a single opening. The acoustic architectural structure may have one or more such channels, with each channel tuned to a specific frequency. The one or more channels can be provided with a neck or be neckless depending on the application sought. One construction utilizes a hollow acoustic architectural structure that is acoustically sealed everywhere except at the opening. Another design utilizes a completely lined acoustic channel with a single opening.

The acoustic materials lining the channel can be selected to increase sound waves absorption or increase sound waves reflection, or both. A sound absorbing material can also be incorporated inside the channel. For example, the channel can be filled with a sound dampening material.

The acoustic architectural structures can be manufactured using specification of desired acoustical properties. The specification of acoustic properties can determine the size of the acoustic channel, the topology of the channel (whether it is open or closed at both or either end, or whether there are more than one cavity, and the cross-sectional profile of the channel), and the shape and material of the acoustic liner. The acoustic architectural structures may be manufactured as individual units or building blocks that are designed to be assembled by joining together.

Returning to FIGS. 4A and 4B, the acoustic liner 16 disposed on the concave surface and/or the convex surface of channel 14 can be made of a high Sound Transmission Class (STC) product to additionally help create an acoustic seal at a section of a wall, or where the wall meets the floor or the ceiling, or any other place where there may be an acoustic leakage. In addition, the acoustic liner can be made from a material, such as SOUNDSENSE LV-1 made by SoundSense Corporation, that has a high STC as well as provide a moisture barrier. The acoustic liner can also be coated with a moisture barrier to provide additional moisture protection.

While various embodiments of the present invention have been described above, it should be understood that they have been presented by way of example, and not limitation. It will be apparent to persons skilled in the relevant art(s) that various changes in form and detail can be made therein without departing from the spirit and scope of the present invention. In fact, after reading the above description, it will be apparent to one skilled in the relevant art(s) how to implement the invention in alternative embodiments. Thus, the present invention should not be limited by any of the above-described exemplary embodiments.

For example, while the present acoustic device is described herein above for application in a room, such as a room of a house or a building, it must be appreciated that the acoustic device can also be used in a recreational vehicle (RV) or in a camper or any vehicle such as in a cabin of a truck or any other volume.

Furthermore, although the mathematical underlining of the various embodiments of the invention described in the above paragraphs are developed for a linear case to allow a better understanding of the underlining acoustical effects, it must be appreciated that a more precise mathematical description of the embodiments can also be performed by additionally taking into account the non-linear aspects of the various embodiments.

Moreover, the method and device of the present invention, like related devices and methods used in acoustics are complex in nature, are often best practiced by empirically determining the appropriate values of the operating parameters, or by conducting computer simulations to arrive at best design for a given application. Accordingly, all suitable modifications, combinations and equivalents should be considered as falling within the spirit and scope of the invention.

In addition, it should be understood that the figures, are presented for example purposes only. The architecture of the present invention is sufficiently flexible and configurable, such that it may be utilized in ways other than that shown in the accompanying figures.

Further, the purpose of the Abstract of the Disclosure is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract of the Disclosure is not intended to be limiting as to the scope of the present invention in any way.

What is claimed is:

1. An acoustic device for altering sound, comprising:

an architectural structure constructed to be mounted on a wall of a room, the architectural structure having a solid body defining a channel therethrough, the channel having a volume (V) and a diameter (d), the solid body having a thickness (z) defined by a maximum distance between an external surface of the solid body and an interface between the solid body and the channel;

wherein the solid body is configured to alter incident low-frequency through high-frequency audible sound waves received by the acoustic device in a manner that includes at least one of absorbing, reflecting, diffracting, or diffusing the incident sound waves; and the channel of the acoustic device absorbs incident sound waves received by the acoustic device, and has an absorbing frequency ($f_H$) determined by the equation:

$$f_H = \frac{1127 \cdot d}{4\sqrt{\pi \cdot V \cdot (z + 1.7 \cdot d/2)}}.$$

2. The acoustic device of claim 1, wherein the solid body is made from a solid material including wood, plastic or metal or a combination of two or more thereof.

3. The acoustic device of claim 1, wherein the solid body is made from an acoustically neutral material.

4. The acoustic device of claim 3, wherein the acoustically neutral material includes foam.

5. The acoustic device of claim 1, wherein the solid body is made from a sound absorbing material or a sound reflecting material, or both.

6. The acoustic device of claim 1, wherein the solid body is made from a laminated material.

7. The acoustic device of claim 1, wherein the solid body is made from wood, plastic, fiberboard, or metal, or a combination of two or more thereof.

8. The acoustic device of claim 1, wherein the solid body comprises a textured surface.

9. The acoustic device of claim 1, wherein the solid body comprises a paint layer applied on a surface of the solid body.

10. The acoustic device of claim 1, wherein the solid body has a cross-sectional shape including a straight shape, a concave or a convex shape, or a combination of two or more thereof.

11. The acoustic device of claim 1, wherein the channel is cylindrical and a cross-section of the channel has a circular shape, a semi-circular shape, an elliptical shape, a semi-elliptical shape, a polygonal shape or a more complex shape.

12. The acoustic device of claim 1, wherein the channel has at least one end open to air.

13. The acoustic device of claim 12, wherein one end of the channel is closed.

14. An acoustic device for altering sound, comprising:

an architectural structure constructed to be mounted on a wall of a room, the architectural structure having a solid body defining a channel therethrough, the channel having a volume (V) and a diameter (d) and defines a cavity therein the solid body having a thickness (z) defined by a maximum distance between an external surface of the solid body and an interface between the solid body and the channel;

wherein the solid body is configured to alter incident low-frequency through high-frequency audible sound waves received by the acoustic device in a manner that includes at least one of absorbing, reflecting, diffracting, or diffusing the incident sound waves;

the channel of the acoustic device absorbs incident sound waves received by the acoustic device, and has an absorbing frequency ($f_H$) determined by the equation:

$$f_H = \frac{1127 \cdot d}{4\sqrt{\pi \cdot V \cdot (z + 1.7 \cdot d/2)}}; \text{ and}$$

the channel includes an acoustic liner disposed on at least a portion of a surface of the channel, and a portion of the incident sound waves received by the acoustic device is absorbed by the acoustic liner.

15. The acoustic device of claim 14, wherein a concave half-surface of the channel is lined with the acoustic liner.

16. The acoustic device of claim 15 wherein a portion of the incident sound waves received by the acoustic device is reflected by the acoustic liner and focused towards the channel.

17. The acoustic device of claim 16, further comprising a secondary sound absorber disposed inside the channel such that sound waves reflected by the concave half-surface of the channel are substantially absorbed by the secondary sound absorber.

18. The acoustic device of claim 14, wherein a convex half-surface of the channel is lined with the acoustic liner.

19. The acoustic device of claim 18, wherein a portion of sound waves incident on the acoustic channel is absorbed by the acoustic liner and another portion of the sound waves is diffused.

20. The acoustic device of claim 14, wherein the acoustic liner is selected from a sound absorbing material, a sound reflecting material or a combination thereof.

21. The acoustic device of claim 14, wherein the acoustic liner is selected so that the acoustic device absorbs, reflects, or absorbs a portion and reflects a portion if incident sound waves having a certain frequency or a range of frequencies.

22. The acoustic device of claim 14, wherein a thickness of the acoustic liner is selected to absorb a certain amount of incident sound waves.

23. The acoustic device of claim 14, wherein the acoustic liner is a tube or a portion of a tube having a sound absorbing material disposed inside a cavity of the tube.

24. The acoustic device of claim 1, wherein when one end of the channel is closed, the acoustic device corresponds to a Helmholtz acoustic absorber.

25. The acoustic device of claim 24, wherein an absorption frequency of the Helmholtz absorber depends upon a thickness of the solid body, a diameter of the channel, and a volume of the channel cavity.

26. The acoustic device of claim 1, further comprising a connecting portion protruding from an end of the channel, the connecting portion adapted to be inserted into a channel of another acoustic device.

27. The acoustic device of claim 26, wherein when an end of the channel is closed, an absorption frequency of the acoustic device depends upon a volume of the cavity of the channel, the speed of sound, an inside diameter of the connecting portion and a height of the connecting portion.

28. The acoustic device of claim 1, wherein the channel cavity is filled with a sound dampening material.

29. The acoustic device of claim 28, wherein the sound dampening material comprises cotton or Dacron, or both.

30. The acoustic device of claim 1, wherein the channel is adapted to form an acoustic seal with a wall of a room.

31. The acoustic device of claim 30, further comprising a liner material disposed on a surface of the channel, the liner material comprising a moisture barrier, a sound absorbing material or both.

32. The acoustic device of claim 1, wherein the architectural structure comprises a ceiling molding, a crown molding, a floor molding, a door frame, a wall frame, a door trim, a window trim, a chair rail, a banister, a balustrade, a baseboard, a ceiling beam, a fireplace mantel, or a picture frame, or any combination thereof.

33. A method of altering sound in a room, comprising:

mounting an acoustic device on a wall of the room, the acoustic device comprising an architectural structure having a solid body defining a channel therethrough, the channel having a volume (V) and a diameter (d), the solid body having a thickness (z) defined by a maximum distance between an external surface of the solid body and an interface between the solid body and the channel;

wherein the solid body is configured to alter incident low-frequency through high-frequency audible sound waves received by the acoustic device; and the channel of the acoustic device absorbs incident sound waves received by the acoustic device, and has an absorbing frequency ($f_H$) determined by the equation:

$$f_H = \frac{1127 \cdot d}{4\sqrt{\pi \cdot V \cdot (z + 1.7 \cdot d/2)}}.$$

34. The method of claim 33, wherein the channel is configured to alter the incident sound waves in a manner that includes at least one of absorbing, reflecting, diffracting, or diffusing the incident sound waves.

35. The method of claim 34, wherein the configuring of the channel comprises closing one opening of the channel.

36. The method of claim 34, wherein the configuring of the channel comprises lining the channel with an acoustic liner.

37. The method of claim 36, wherein lining the channel with an acoustic liner comprises lining a concave half-surface of the channel with the acoustic liner such that a portion of sound waves incident on the architectural structure is absorbed by the acoustic liner and another portion is reflected by the acoustic liner and focused towards the channel.

38. The method of claim 37, further comprising disposing a secondary sound absorber disposed inside the channel such that sound waves reflected by the concave half-surface of the channel are substantially absorbed by the secondary sound absorber.

39. The method of claim 36, wherein the lining of the channel with an acoustic liner comprises lining a convex half-surface of the channel with the acoustic liner such that a portion of sound waves incident on the architectural structure is absorbed by the acoustic liner and an other portion of the sound waves is diffused.

40. The method of claim 34, wherein the configuring of the channel comprises configuring the acoustic device to correspond to a Helmholtz acoustic absorber.

41. The method of claim 34, wherein the configuring of the channel comprises filing the channel cavity with a sound dampening material.

42. The acoustic device of claim 1, wherein:

the channel is parallel to a lateral surface of the solid body, the channel having an outer surface, a first end, and a second end; and an acoustic liner that lines the outer surface of the channel, the acoustic liner having a thickness from the outer surface of the channel to an interface between the acoustic liner and the solid body;

wherein the solid body is configured to alter incident low-frequency through high-frequency audible sound waves received by the acoustic device, and the acoustic liner absorbs audible sound waves received by the acoustic device.

* * * * *